United States Patent [19]

Kennedy

[11] 4,311,178

[45] Jan. 19, 1982

[54] INTERIOR SPACE DIVIDER FOR GOLF BAG

[76] Inventor: Robert A. Kennedy, 600 E. Barber Dr., Hemet, Calif. 92343

[21] Appl. No.: 211,727

[22] Filed: Dec. 1, 1980

Related U.S. Application Data

[63] Continuation-in-part of Ser. No. 81,653, Dec. 5, 1979, abandoned.

[51] Int. Cl.[3] ..... A63B 55/00

[52] U.S. Cl. ..... 150/1.5 R

[58] Field of Search ..... 150/1.5 R, 1.5 B, 1.5 C, 150/34; 220/21; 229/15; 190/51

[56] References Cited

U.S. PATENT DOCUMENTS

| | | | |
|---|---|---|---|
| 1,373,577 | 4/1921 | Vallens | 229/15 X |
| 1,945,878 | 2/1934 | Breton | 229/15 X |
| 2,582,655 | 1/1952 | Schenk | 206/443 X |
| 2,713,962 | 7/1955 | Camp | 229/15 X |
| 2,722,258 | 11/1955 | Smidt | 150/1.5 R |
| 2,743,836 | 5/1956 | Roberts | 220/21 X |
| 2,911,024 | 11/1959 | Miceli | 150/34 |
| 3,217,771 | 11/1965 | Skirow | 220/21 X |
| 4,172,484 | 10/1979 | Henning | 150/1.5 B |
| 4,210,186 | 7/1980 | Belenson | 150/52 J |
| 4,260,004 | 4/1981 | Domke | 150/52 J X |

FOREIGN PATENT DOCUMENTS

| | | | |
|---|---|---|---|
| 481773 | 3/1952 | Canada | 150/1.5 R |

*Primary Examiner*—Donald F. Norton
*Attorney, Agent, or Firm*—Henri J. A. Charmasson

[57] ABSTRACT

A golf bag insert is provided having a generally cylindrical sheath made from a preferably resilient material cut from a single sheath, there being longitudinal divider panels which are inserted into the cylinder defined by the sheath, these panels having laterally projecting tabs which engage in the slots in the sheath to retain the panels in place and also to hold the sheath together by virtue of a pair of tabs which penetrate two pairs of overlying slots in the edges of the sheath-defining sheet. The dividers each have one or more longitudinal slots defined approximately one-half way into the panel from one end so that the various dividers mate in orthogonal-parallel relation to define a plurality of subdivided compartments.

4 Claims, 9 Drawing Figures section c view a view b

INTERIOR SPACE DIVIDER FOR GOLF BAG

The instant application is a continuation-in-part of application Ser. No. 81,653 filed Dec. 5, 1979 by the same inventor, Robert A. Kennedy, on an invention entitled KENNEDYS GOLF BAG INSERT, now abandoned.

BACKGROUND OF THE INVENTION

It is well recognized that a golf bag is better utilized by the incorporation therein of a divider structure of one kind or another. Otherwise, the clubs rub together and chafe one another as they are carried over the golf course, and additionally they may become somewhat entangled with certain of the clubs being difficult to extricate from the others without banging them around somewhat, which, of course, over a period of time, results in the deterioration of the condition of the clubs.

A number of different devices and systems have been devised to properly separate the clubs, one of the more popular being the small diameter plastic tubes that extend a substantial length of the bag, each of which holds the shaft of a single club. Although these tubes successfully space the clubs somewhat from one another, they are often a bit tedious because of their narrow diameter inasmuch as the shaft and handle of each club must be piloted into the open end of the tube, a process which happens repeatedly over the course of a golf game. It is also difficult to extricate the clubs because of the narrowness of the tube, and the tubes have a maddening tendency to ride out of the bag on the club shaft.

There is a need for an inexpensive, simply made divider structure which can be retrofitted into any golf bag, and moved from one golf bag to another so an old golf bag wears out without loss of utility, and which subdivides the golf bag not necessarily into a single compartment for each club, but rather into several compartments, each having a plurality of clubs, eliminating the piloting problem but still sufficiently separating the clubs to achieve the result desired of a separator.

SUMMARY OF THE INVENTION

The present invention fulfills the above-stated need by providing a divider which creates in the preferred embodiment six separate compartments by the utilization of an elegantly simple structure comprising four planar panels, one of which is a resilient yet flexible sheet which wraps to define a cylinder or sheath to line the golf bag, and the other three of which define interlocking divider panels insertable and retained in the cylinder.

The cylindrical sheath utilizes spaced slots which engage tabs extending from the lateral edges of the panels, and the panels themselves have extensive longitudinally entrant slots which permit them to interlock one another orthogonally to define the appropriate compartments.

DETAILED DESCRIPTION OF THE PREFERRED EMBODIMENT

Figure 1:
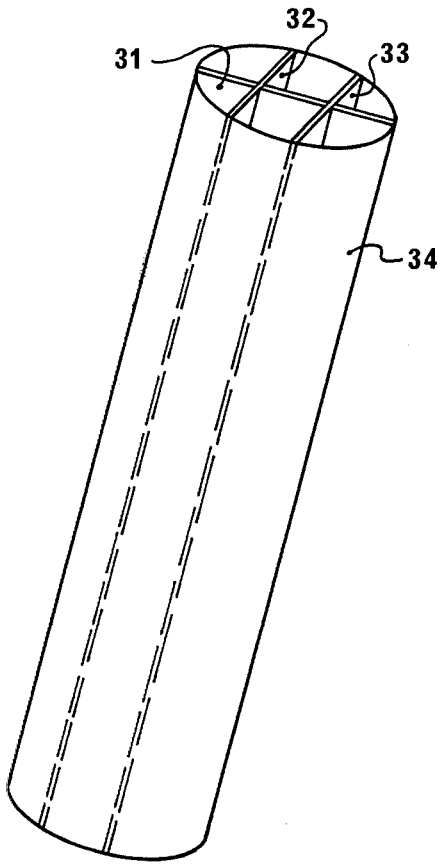
FIG. 1 is a perspective view of the assembled divider showing in dashed line the position of the interior dividers in the sheath.
Figure 1A:
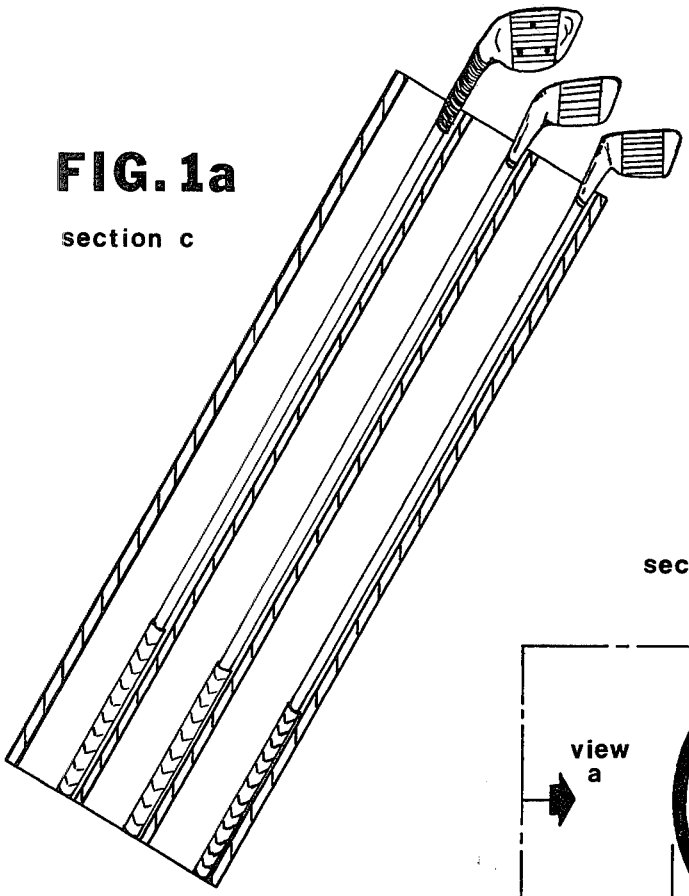
FIG. 1*a*, subtitled, section "c", is a section taken along the line indicated at section "c" in FIG. 2.
Figure 8:
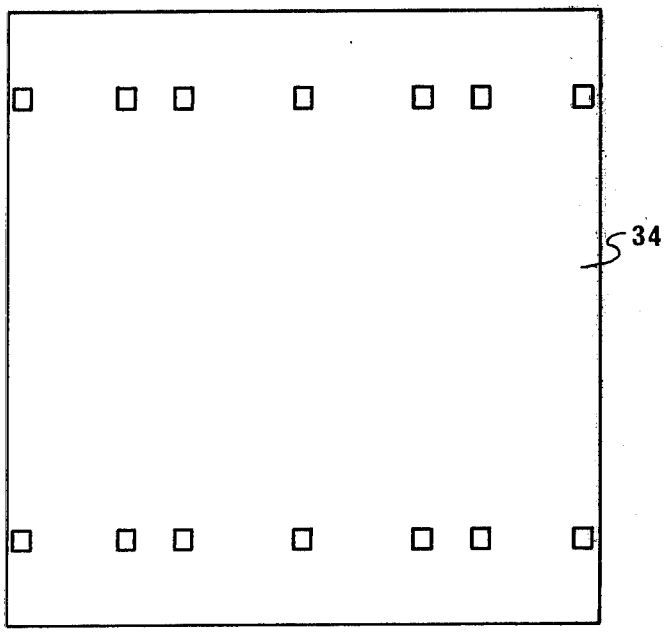
FIG. 8 is a plan form view of the sheet used to form the sheath prior to being rolled into a cylinder.

The divider as shown assembled in FIG. 1 and the parts can best be seen in FIGS. 4 through 8. The outer sheath is indicated at 34 and as indicated in FIG. 8 is provided with a plurality of spaced slots 35, strategically positioned to properly position tabs 36 which extends laterally from the side edges of all three divider panels 31 through 33. Whereas the sheet 34 used for the sheath must be flexible so it will define a cylinder as shown in FIGS. 1 through 3, the divider panels 31 through 33 can be rigid and made of a thin, lightweight material such as rigid vinyl, plastic, plexiglass, or other suitable material.

Panel 31 defines a pair of longitudinal slots 37 which interlock respectively with the divider slots 38 provided in the divider panels 32 and 33. Once interlocked as shown in FIG. 1, the tabs 36 fit snugly in slots 35 so that as long as the sheet 34 is cylindrical, relative axial motion of panels 31 through 33 is prevented.

Figure 2:
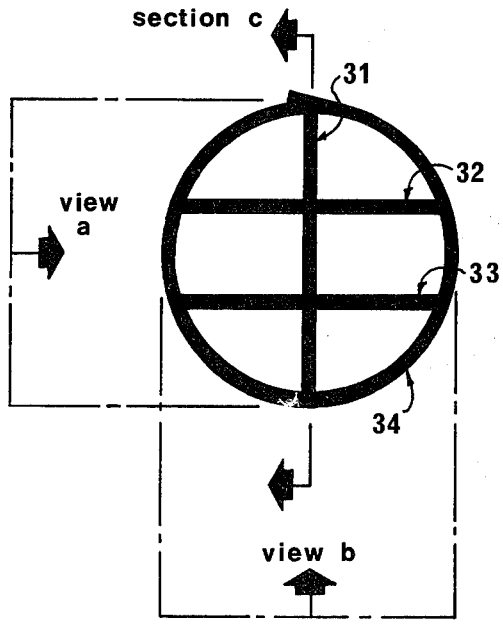
FIG. 2 is a somewhat diagrammatic top elevation view of the assembled insert shown in FIG. 1.
Figure 3:
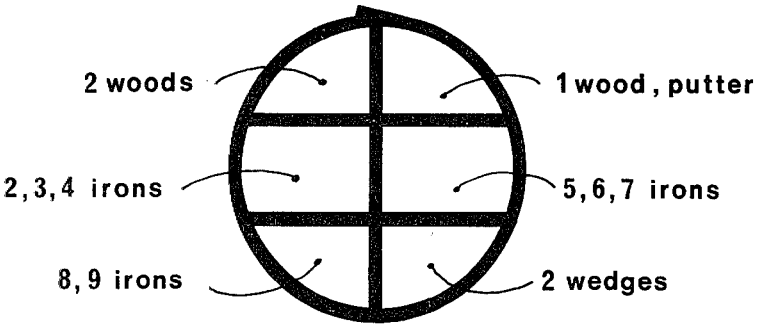
FIG. 3 is a view identical to that of FIG. 2 with the intended positioning of the various golf clubs in the divider indicated.
Figure 4:
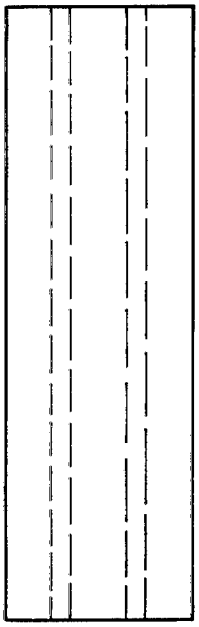
FIG. 4 is a side elevation view looking parallel to the two parallel divider panels and showing their position inside the outer sheath indicated in dashed lines.
Figure 5:
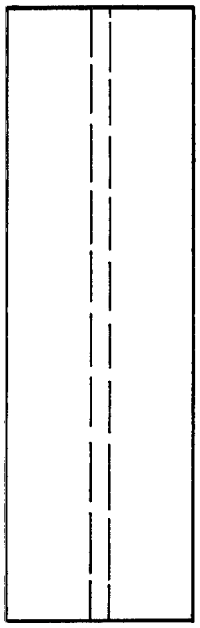
FIG. 5 is a side elevation view similar to FIG. 4 but looking parallel to the single divider 31.
Figure 6:
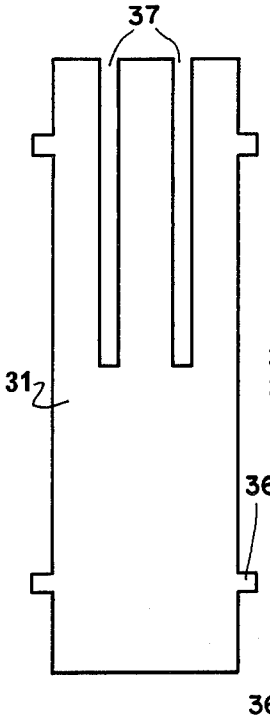
FIG. 6 is a side elevation view of divider 31.
Figure 7:
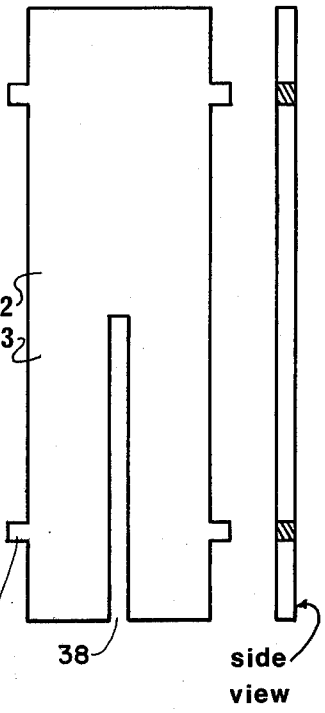
FIG. 7 is a side elevation view of identical dividers 32 and 33, together with a elevation view of the right side of panels 32 and 33 indicated as "side view"

Additionally, the laterally outermost of the slots 35 overlap as indicated diagrammatically in FIGS. 2 and 3 so that each of these overlying slot pairs is engaged by a single tab, so that not only does the sheath 34 hold dividers 31 through 33 in place, but the dividers hold in a sheath in its cylindrical form.

As thus described, the golf bag divider can be extremely simply and economically made by die-cutting flat panel stock and may be shipped flat. Because of the quality of design, the divider can be assembled in just a few seconds at the point of destination, and when installed in the proper sized golf bag, the golf bag will tend to fold the sheath in place which will in turn lock all of the divider panels together. A certain range of sizes of the divider would be provided to accommodate different sized golf bags.

What is claimed is:

1. An interior space divider for a golf bag comprising:

(a) an outer flexible sheath defined from a single sheet wrapped to define a generally cylindrical shape;

(b) a plurality of generally planar, rigid, divider panels dimensioned to extend the substantial length of said golf bag to subdivide the cross sectional area thereof into compartments; and (c) locater means on said sheath for engaging and positioning said divider panels in predetermined orientations in said bag, said locater means comprising a plurality of spaced slots and said panels being generally rectangular with laterally projecting tabs engated in said slots.

2. The structure according to claim 1 wherein the two longitudinal edges of said sheath-defining sheet overlap, defining overlying slot pairs and said sheath is maintained in generally cylindrical shape by the tabs engaged in said slot pairs.

3. The structure according to claim 1 wherein said panels are elongated to define two opposite ends, a first one of said panels having at least one longitudinal slot entrant from one end thereof and a second of said panels having a longitudinal slot entrant from the other end, and said first and second slots being interlocked along said elongated slots in orthogonal relation and being secured against axial disengagement by means of said tabs engaged in said locater means slots.

4. The structure according to claim 3 wherein said first panel has two parallel spaced longitudinal slots entrant from one end and including a third panel parallel to said second panel and engaged in one of said longitudinal slots to define six separate compartments in said sheath.

* * * * *